US005317777A

United States Patent [19]

Stoltz

[11] Patent Number: 5,317,777

[45] Date of Patent: Jun. 7, 1994

[54] AUTOMATIC POOL CLEANER AND STEERING DEVICE THEREFOR

[76] Inventor: Gerhardus J. Stoltz, 373 Ronald Street, Garsfontein, Pretoria, South Africa

[21] Appl. No.: 17,002

[22] Filed: Feb. 12, 1993

[30] Foreign Application Priority Data

Apr. 14, 1992 [ZA] South Africa ..... 92/1073

[51] Int. Cl.[5] ..... F04H 3/20

[52] U.S. Cl. ..... 15/1.7

[58] Field of Search ..... 15/1.7

[56] References Cited

U.S. PATENT DOCUMENTS

| | | | |
|---|---|---|---|
| 4,208,752 | 6/1980 | Hofmann | 15/1.7 |
| 4,351,077 | 9/1982 | Hofmann | 15/1.7 |
| 4,769,867 | 9/1988 | Stoltz | 15/1.7 |

*Primary Examiner*—Edward L. Roberts

*Attorney, Agent, or Firm*—Oblon, Spivak, McClelland, Maier & Neustadt

[57] ABSTRACT

An automatic swimming pool cleaning apparatus includes a steering device for randomly steering the apparatus. The steering device includes a first steering arm projecting from the cleaning head in a direction transverse to the direction of movement of the apparatus, a proximal end of the arm being pivotally connectable to the cleaning head about an axis substantially parallel to the direction of movement; a suction device for intermittent application of suction to the surface of the swimming pool, connected to the steering arm at a position spaced from a proximal end thereof; and a mechanism for intermittently causing suction to be applied to the suction device.

18 Claims, 3 Drawing Sheets

AUTOMATIC POOL CLEANER AND STEERING DEVICE THEREFOR

FIELD OF THE INVENTION

This invention relates to the cleaning of submerged surfaces such as in a swimming pool. More particularly, the invention relates to a swimming pool cleaning apparatus, to a steering device suitable for use with the swimming pool cleaning apparatus and to a cleaning disc for use with the steering device.

BACKGROUND TO THE INVENTION

Automatic swimming pool cleaning apparatuses have become very popular for the cleaning of swimming pools. A variety of different designs of automatic pool cleaners are known to the applicant.

A common feature of most automatic pool cleaners is that they are propelled over the surface to be cleaned when water is induced to flow through a cleaning head of the apparatus by the suction of conventional swimming pool circulation equipment. The circulation is repeatedly interrupted at least to a substantial degree, by a valve or other means in the cleaning head, causing a pulsating flow as a result of which a pulsating force is generated which moves the apparatus in small steps in a random pattern over the floor and walls of the swimming pool. This allows the surfaces to be cleaned by water flowing through the swimming pool cleaning apparatus via a suction hose to the circulation equipment which usually comprises a filter such as a sand filter which filters out any dirt picked up by the cleaning apparatus.

Automatic swimming pool cleaning apparatuses of the aforementioned type are generally also equipped with a substantially flat circular cleaning disc made of a flexible material which engages with and holds the cleaning head in contact with the surface to be cleaned. Such conventional pool cleaning apparatuses are described for example in U.S. Pat. Nos. 3,803,658 to Raubenheimer, 4,023,227 to Chauvier, 4,133,068 to Hofman, 4,642,833 to Stoltz et al and 4,769,867 to Stoltz.

It is a common feature of all the aforementioned swimming pool cleaning apparatuses that they move around the pool in a random fashion. The direction of travel is influenced by the position of the suction hose, the shape of the swimming pool and forces acting on the suction hose and/or cleaning apparatus, such as return water jets, wind, wave action, gravity, flotation, hose stiffness, etc. These forces acting on the hose and/or the swimming pool cleaning apparatus could have the result that not all of the internal surfaces of the swimming pool are traversed at the same frequency, with the result being that some areas may not be cleaned as efficiently or as frequently as operating conditions in the pool may demand. Worse yet, some areas may not be cleaned at all.

In an effort to improve the cleaning pattern, a variety of devices have been fitted to conventional swimming pool cleaning apparatuses. They generally comprise a buoyancy member in combination with a weight, both of which improve the random pattern of movement. They cannot, however, effectively steer the swimming pool cleaning device on the floor or wall surfaces of the swimming pool, with the result that long cycle times are required to clean the pool completely. Under adverse conditions as aforesaid, they sometimes still fail to reach certain areas of the pool, such as in the region of the return flow jet.

SUMMARY OF THE INVENTION

It is an object of the present invention to provide a steering device suitable for use with a swimming pool cleaning apparatus, which provides positive random steering to the apparatus.

It is a further object of the invention to provide a swimming pool cleaning apparatus comprising a steering device for positively steering the apparatus randomly through the swimming pool.

Another object of the invention is to provide a cleaning disc suitable for use with the steering device in accordance with the invention or with a swimming pool cleaning apparatus in accordance with the invention.

Further objects and advantages of the invention will become more apparent from a reading of the following statements of the invention and description of an embodiment thereof.

According to a first aspect of the invention, there is provided a steering device suitable for use with a swimming pool cleaning apparatus including a cleaning head, a first end of the cleaning head being rotatably connectable about a first axis in line with the direction of flow through the cleaning head, to a flexible suction hose of a circulating system for circulating water through the cleaning head, the suction hose and back to the swimming pool; means for pulsating the flow through the cleaning head so as to cause the cleaning apparatus to be propelled along a surface of the swimming pool in a direction of movement; and a flexible, surface engaging cleaning disc rotatably mountable adjacent a second end of the cleaning head about a second axis forming an angle with the direction of flow of water through the cleaning head, the steering device comprising:

a first steering arm projecting from the cleaning head in a direction transverse to the direction of movement, a proximal end of the arm being pivotally connectable to the cleaning head, about a third axis substantially parallel to the direction of movement;

a suction device communicating with a low pressure region in the cleaning head, for intermittently applying suction to the surface of the swimming pool, said suction device being connected to the steering arm at a position spaced from a proximal end thereof; and mechanism for intermittently causing the suction device to apply suction to the surface of the swimming pool, whereby, each time the suction device applies suction to the surface of the swimming pool, the steering arm exercises a steering moment on the cleaning apparatus, causing it to change its direction of movement.

The mechanism is preferably provided with at least one perforation through the cleaning disc spaced from its center, the suction device being adapted to apply suction to the surface of the swimming pool through the perforation in the cleaning disc each time the cleaning disc is rotated to a position in which the perforation is in register with the surface engaging means.

According to a second aspect of the invention, there is provided a steering device suitable for use with a swimming pool cleaning apparatus including a cleaning head; means for rotatably connecting a first end of the cleaning head about a first axis in line with the direction of flow through the cleaning head, to a flexible suction pipe of a circulation system for circulating water through the cleaning head, the suction pipe and back to the swimming pool; means for pulsating the flow through the cleaning head so as to cause the cleaning apparatus to be propelled along the surface of the swimming pool in a direction of movement; the steering device comprising:

a flexible, surface engaging cleaning disc rotatably mountable adjacent a second end of the cleaning head about a second axis forming an angle with the direction of flow of water through the cleaning head, the cleaning disc being provided with at least one perforation spaced from its center;

a first steering arm projecting from the cleaning head in a direction transverse to the direction of movement, a proximal end of the arm being pivotally connectable to the cleaning head about a third axis substantially parallel to the direction of movement;

a suction device communicating with a low pressure region in the cleaning head, for intermittently applying suction to the surface of a swimming pool through the perforation in the cleaning disc; and a mechanism for intermittently causing the suction device to apply suction to the surface of the swimming pool, whereby, each time the suction device applies suction to the surface of the swimming pool, the steering arm exercises a steering moment on the cleaning apparatus, causing it to change its direction of movement.

In an advantageous embodiment of the invention, the steering device comprises, in addition, a second steering arm projecting from the cleaning head on the opposite side thereof in a direction substantially transverse to the direction of movement, a proximal end of the second arm being pivotally connectable to the cleaning head about a fourth axis which is also substantially parallel to the direction of movement and comprising a second suction device and a second mechanism similar to those of the first steering arm.

In this embodiment of the invention, the cleaning disc of the steering device or of the cleaning apparatus, as the case may be, is conveniently provided with a plurality of angularly spaced perforations, each perforation being provided at the same distance from the center of the disc as the surface engaging means, the arrangement being such that, irrespective of the rotational position of the disc about the cleaning head, no two perforations can be located such as to simultaneously be in register with the surface engaging means of the first and second arms. The perforations may be spaced randomly with respect to one another or according to a desired pattern.

Conveniently, the or each suction device comprises a suction cup adapted, upon water being sucked therefrom, to be pushed towards the surface of the swimming pool by the pressure of the water in the pool. In this way, the friction between the suction cup or the cleaning disc, as the case may be, and the surface of the swimming pool is increased such as to cause the swimming pool cleaning apparatus to be steered into a different direction of movement. In order to obtain suction under the suction cup, the mechanism may comprise a tube, preferably a flexible non-collapsible tube, connecting the suction device with the low pressure region of water flowing through the cleaning head.

Conveniently, the suction device is located when in use above the cleaning disc of the cleaning apparatus so that, when the disc is rotated about the second axis as a result of differential operation of frictional forces on it when the cleaning apparatus is moving through the swimming pool, perforations move out of or into register with the suction cup or one of the two suction cups (in the event that the steering device has a first and second steering arm). As a result, suction is applied via the suction device to the surface of the swimming pool, causing the friction in the area of the suction cup to be increased, thus slowing down the cleaning apparatus on that side of the disc on which the perforation is in register with the corresponding suction cup, causing it to be steered into a different direction.

The steering arms may be secured in their respective positions by means of hinges flexibly or hingebly mounted to the cleaning head and may comprise retention means for holding them down on the top surface of the cleaning disc or on the surface of the pool in such a way that lateral movement of the steering arms relative to the cleaning head in the direction of the third and/or fourth axes is restricted, while pivotal movement of the steering arms is allowed about the third and/or fourth axes.

The or each suction cup may have a concave shape. The or each suction cup may for as long as they are out of register with a perforation, engage with the top surface of the cleaning disc, or, in the event that a perforation is in register with the suction cup, with the surface of the swimming pool.

As a further feature of the invention, there may be provided at least one directional or flow control element in the or each steering arm or along the tube interconnecting the suction cup with the low pressure region. In addition, the steering device may comprise means to alternately or simultaneously direct or stop the flow of water from each of the suction cups. Such means may be incorporated in any position between the suction cups and the cleaning head of the swimming pool cleaning apparatus.

The rotational movement of the cleaning disc may provide the means for regulation and control of the flow of water through the suction cups. Rotational movement of the disc may be obtained by any known mechanical means or as a result of differential friction between opposing sides of the disc and the surface to be cleaned, causing the disc to rotate relative to the cleaning head of the swimming pool cleaning apparatus as it moves along the surface to be cleaned.

The invention also extends to a swimming pool cleaning apparatus comprising a steering device as hereinbefore disclosed, and to a cleaning disc for use with the cleaning apparatus or steering device as hereinbefore disclosed.

DESCRIPTION OF THE PREFERRED EMBODIMENT

Figure 1:
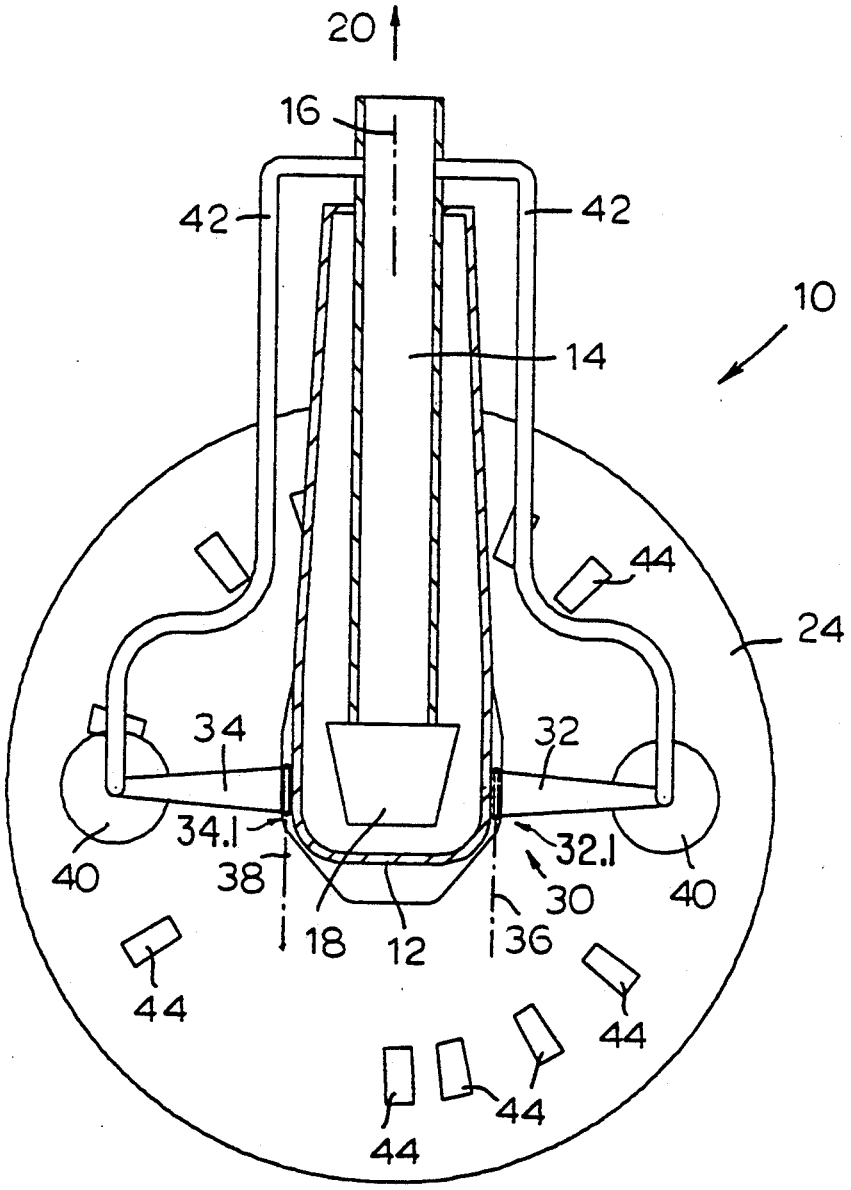
FIG. 1 is a diagrammatic part sectional plan view of a swimming pool cleaning apparatus and a steering device in accordance with the invention.

Referring to FIG. 1, reference numeral 10 generally indicates the swimming pool cleaning apparatus.

The cleaning apparatus 10 comprises an elongated hollow cleaning head 12 accommodating a main suction tube 14, a first end 14.1 of which is rotatably connectible about a first axis 16 which is in line with the direction of flow through the cleaning head 12, to a flexible suction hose (not shown) of a circulating system for circulating water through the cleaning head 12, the suction hose and via the circulation pump and filter back to the swimming pool. At the lower end of the main suction tube 14, a pulse generating valve 18 is provided for pulsating the flow through the cleaning head 12, so as to cause the cleaning apparatus 10 to be propelled along a surface of the swimming pool in a direction of movement indicated by the arrow 20.

Figure 2:
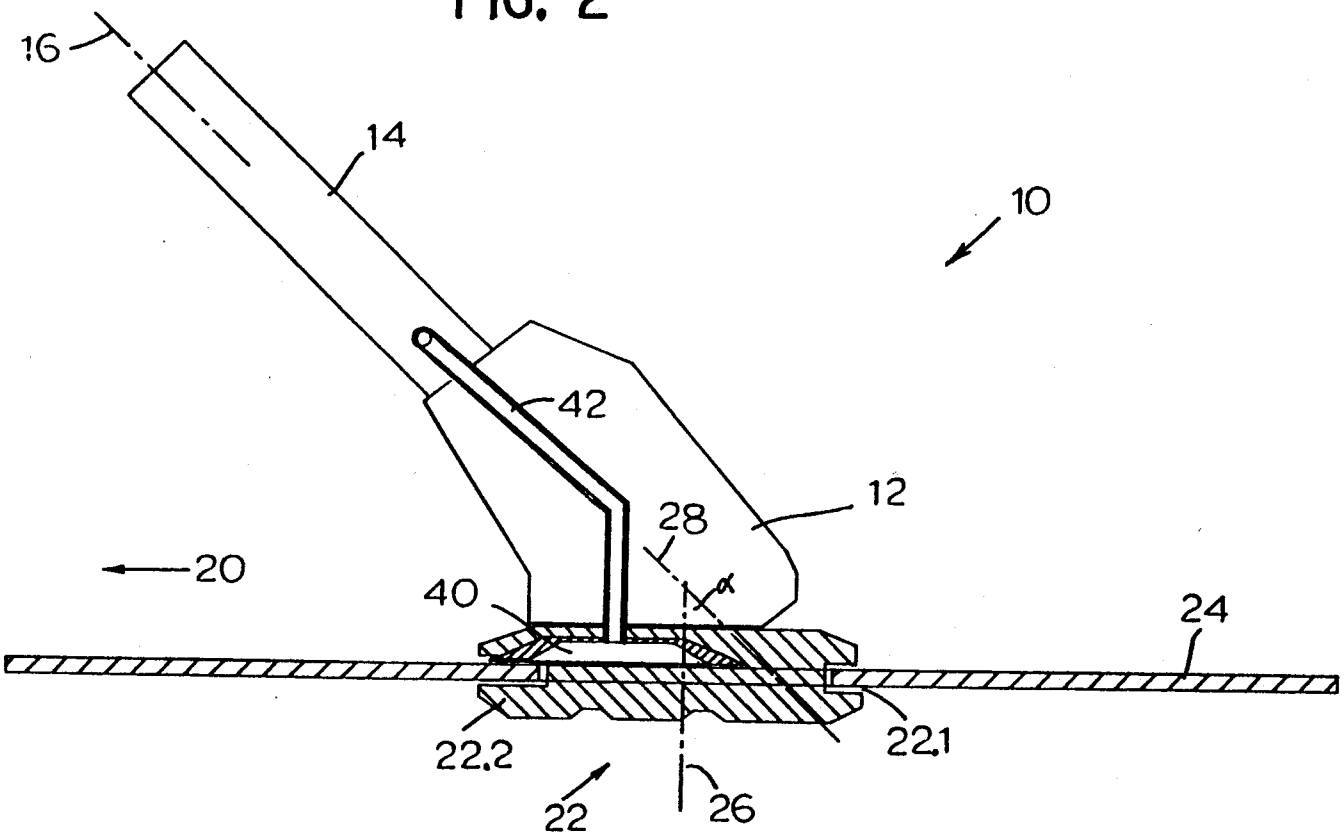
FIG. 2 is a diagrammatic, part by sectional side elevational view of the apparatus and device of FIG. 1.

The cleaning head 12 has been shaped such as to present a substantially circular flanged hub 22 at its underside, the hub 22 having a circumferentially extending groove 22.1 adjacent a flange 22.2 (see FIG. 2).

A circularly shaped flexible cleaning disc 24 made of a suitable plastics material has a central hole (not shown) fitting loosely into the groove 22.1 of the flanged hub 22, so that the cleaning disc 24 is capable of rotating about a second axis 26 forming an angle 60 with the direction of flow of water through the cleaning head, indicated by the broken line 28.

The cleaning apparatus 10 is provided with a steering apparatus 30 comprising a first steering arm 32 and a second steering arm 34. The steering arms 32, 34 project from the cleaning head 12 in a direction transverse to the direction of movement 20, a proximal end 32.1, 34.1 of each of the steering arms 32, 34, being pivotally connectable to the cleaning head 12 about respectively a third axis 36 and a fourth axis 38 each of which is substantially parallel to the direction of movement 20.

The steering device 30 further comprises a suction device comprising a suction cup 40 attached to the free end of each of the steering arms 32, 34. Each suction cup 40 is connected by means of a flexible non-collapsible tube 42 to a low pressure region inside the main suction tube 14, adjacent its first end 14.1. The suction cups 40 are made from a suitable resiliently flexible synthetic plastics material.

The cleaning disc 24 is similar to conventional cleaning discs, save that it is provided with suitably sized and spaced perforations or holes 44 which are angularly spaced over the surface of the cleaning disc 24, each at the same distance from the center of the cleaning disc 24 as the suction cups 40. The holes or perforations 44 as shown are rectangularly shaped, but may have any other shape which would fit in under the suction cups 40. The suction cups 40 are shown to be disc shaped, but they may also vary in size and shape.

It is to be understood that although the steering arms 32, 34 are shown to have a length such that the suction cups 40 are positioned over the disc 24, the steering arms 32 could be long enough so as to extend beyond the edge of the cleaning disc 24 in which event the suction cups 40 will engage with the floor or walls of the swimming pool. This configuration may be advantageous in appropriate circumstances but the configuration as shown in FIG. 1 is preferred for household swimming pools.

It is also important to note that the holes 44 are spaced such that, irrespective of the rotational position of the disc 24 about the cleaning head 12, no two holes or perforations 44 are located such as to simultaneously be in register with the suction cups 40.

The arms 32, 34 may comprise a plurality of members (not shown) to permit articulation for ease of negotiating corners or uneven surfaces. They may also be provided with means such as a spring or other resilient member (not shown) causing a downward pressure of the suction cups 40 against the top surface of the cleaning disc 24 to maintain contact of the lower faces of the suction cups 40 with the top surface of the cleaning disc 24. The top surface of the disc 24 is preferably smooth with a corresponding surface provided on the underside of the suction cup 40 to ensure suitable sealing between the two surfaces, whilst still permitting the disc 24 to rotate when the suction cup 40 is in contact with the disc 24.

The tubes 42 are preferably of a flexible material resistant to collapse under suction and are connected at a point downstream of the valve 18 to the interior of the suction tube 14 so that water flowing through the suction tube 14 in the direction of the arrow 20 will cause a pulsating suction action through the tubes 42 to the cups 40 as the valve 18 repeatedly opens and closes under the influence of the water flowing through the valve 18 into the suction tube 14. It is to be understood that the suction increases when the valve 18 closes and decreases when it opens.

The disc 24 which is rotatably mounted to the hub 22 as described hereinabove will at least partially rotate in either direction relative to the hub 22 as the apparatus 10 moves along the surface of the swimming pool due to the differential effect of friction between the disc 24 and the pool surface and to changes in the direction of movement of the swimming pool cleaning apparatus 10 brought about by the forces referred to before.

This rotational movement is of a random nature and will obviously be more pronounced when the swimming pool cleaning apparatus 10 is under the influence of frequent or strong exterior forces (as referred to above) causing it to change direction more frequently.

From time to time, the rotational movement of the disc 24 causes one of the holes 44 in the disc 24 to align with one of the cups 40. The other cup 40 cannot be in alignment due to the spacing of the holes 44 in the disc 24 being so positioned that no two holes 44 can align with the cups 44 simultaneously. When one of the cups 40 is aligned with one of the holes 44 of the disc 24, suction is applied to the pool surface through the disc 24 which causes a region of the disc 24 in the immediate proximity of the hole 44, to be pushed against the surface of the pool wall or floor by the pressure of water in the pool. The cup 40 and relevant steering arm 32, 34 prevents the disc 24 from rotating freely around the hub 22 for as long as suction is applied to the respective cup 40. The swimming pool cleaning apparatus 10 is thus caused to change direction due to the braking action of the disc 24 on that side of the head 12 where the hole 44 is in register with a cup 40. The cup 40 on the other side of the head 12 may be provided with means to hold the disc 24 against rotating or may permit at most only partial rotation of the disc 24 relative to the head 12 of the swimming pool cleaning device 10.

The suction applied to the cups 40 is increased to coincide with the forward acceleration of the swimming pool cleaning device or is decreased when the swimming pool cleaning device decelerates. This is a result of the action of the valve 18 as it repeatedly opens and closes causing a variation of pressure in the main suction tube 14. A lower suction pressure lowers the frictional engagement between the cups 40 and the disc 24 thereby permitting the disc 24 to partially rotate until a cup 40 again finds alignment with a hole 44 in the disc 24. Such alignment could occur at random at either side of the head 12, causing the steering device 30 to steer the swimming pool cleaning apparatus 10 repeatedly as it moves along the surface of the pool.

The disc 24 should preferably be capable of rotating freely relative to the head 12 so that it will not wear out prematurely in any one area.

The suction cup 40 can be shaped to be concave and the lower face of the disc 24 may also be shaped to increase the size of the low pressure area under the disc 24 in the proximity of the holes 44 in the disc 24.

The holes 44 in the disc 24 may be of a variety of different shapes and may comprise strainers, slots or screens to prevent debris from entering the suction cups 40 and tubes 42. Likewise, the cups 40 may be fitted with similar screens or strainers.

Figure 3:
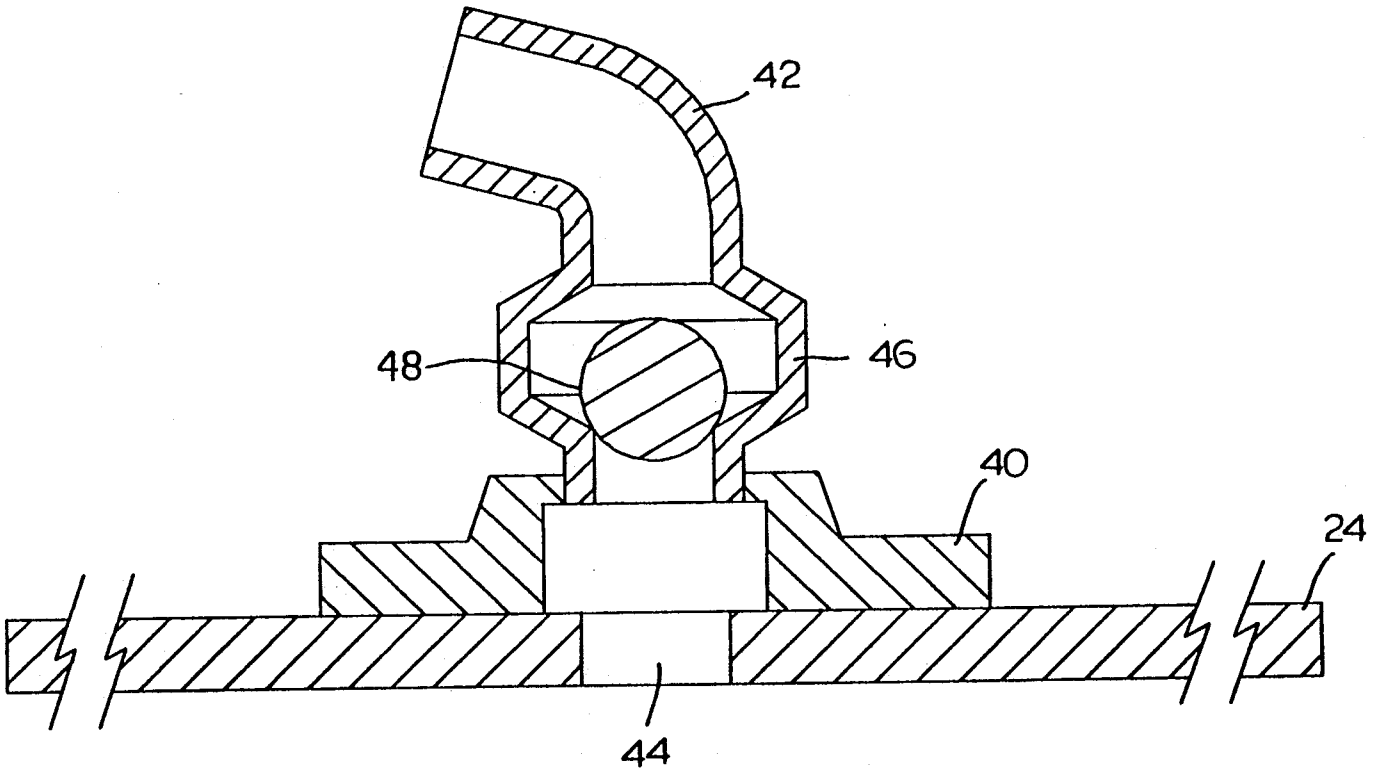
FIG. 3 is an enlarged cross sectional diagrammatic view of surface engagement means showing also a portion of a cleaning disc.

Referring to FIG. 3, a flow control valve 46 may be provided in one or both of the tubes 42 to limit the flow of water in the event that the flow increases above a desired rate, which could occur when the suction areas of the disc 24 and the cups 40 are not in contact with the pool surface. The valves 46 may be in the form of weighted balls 48 which may be sensitive to flow and which will at least partially reduce the flow through the valves 46 when the flow rate increases to above the desired rate, but will reopen when the flow rate drops as will occur when the cups 40 and the disc 24 are at least partially sealed against the surface to be cleaned.

The claims which follow are to be considered an integral part of the present disclosure.

I claim:

1. A steering device suitable for use with a swimming pool cleaning apparatus including a cleaning head, a first end of the cleaning head being rotatably connectable about a first axis in line with the direction of flow through the cleaning head to a flexible suction hose of a circulating system for circulating water through the cleaning head, the suction hose and back to the swimming pool; a device for pulsating the flow through the cleaning head so as to cause the cleaning apparatus to be propelled along a surface of the swimming pool in a direction of movement; and a flexible, surface engaging cleaning disc rotatably mounted adjacent a second end of the cleaning head about a second axis forming an angle with the direction of flow of water through the cleaning head, the steering device comprising:

first steering arm projecting from the cleaning head in a direction transverse to the direction of movement, a proximal end of the arm being pivotally connectable to the cleaning head about a third axis substantially parallel to the direction of movement;

a suction device communicating with a low pressure region in the cleaning head, for intermittently applying suction to the surface of the swimming pool, said suction device being connected to the steering arm at a position spaced from a proximal end thereof; and a mechanism for intermittently causing the suction device to apply suction to the surface of the swimming pool, such that, each time the suction device applies suction to the surface of the swimming pool, the steering arm exercises a steering moment on the cleaning apparatus, causing the steering apparatus to change its direction of movement.

2. A steering device as claimed in claim 1, wherein the mechanism includes at least one perforation through the cleaning disc spaced from the center of the cleaning disc, and wherein the suction disc applies suction to the surface of the swimming pool through the perforation in the cleaning disc each time the cleaning disc is rotated to a position in which the perforation is in register with the suction device.

3. A cleaning device as claimed in claim 2, wherein said mechanism, comprises a tube interconnecting the suction device with said low pressure region in the cleaning head.

4. A steering device as claimed in claim 1, comprising a second steering arm projecting from the cleaning head on the opposite side thereof in a direction substantially transverse to the direction of movement, a proximal end of the second steering arm being pivotally connected to the cleaning head about a fourth axis which is also substantially parallel to the direction of movement, said second steering arm comprising a second suction device communicating with a low pressure region in the cleaning head, for intermittently applying suction to the surface of the swimming pool, said second suction device being connected to the steering arm at a position spaced from a proximal and thereof; and a second mechanism for intermittently causing the second suction device to apply suction to the surface of the swimming pool, such that each time the second suction device applies suction to the surface of the swimming pool, the second steering arm exercises a steering moment on the cleaning apparatus, causing the cleaning apparatus to change the direction of movement thereof.

5. A steering device as claimed in claim 4, wherein the cleaning disc of the cleaning apparatus is provided with a plurality of angularly spaced perforations, each perforation being provided at the same distance from the center of the disc as the suction devices, the arrangement being such that, irrespective of the rotational position of the disc about the cleaning head, no two perforations will be located such as to simultaneously be in register with the suction devices of the first and second arms.

6. A cleaning device as claimed in claim 1, wherein the suction device comprises a suction cup adapted, upon water being sucked therefrom, to be pushed towards the surface of the swimming pool by the pressure of the water in the pool.

7. A steering device suitable for use with a swimming pool cleaning apparatus including a cleaning head; a mechanism for rotatably connecting a first end of the cleaning head about a first axis in line with the direction of flow through the cleaning head, to a flexible suction pipe of a circulation system for circulating water through the cleaning head, the suction pipe and back to the swimming pool; a mechanism for pulsating the flow through the cleaning head so as to cause the cleaning apparatus to be propelled along the surface of the swimming pool in a direction of movement; the steering device comprising:

a flexible, surface engaging cleaning disc rotatably mountable adjacent a second end of the cleaning head about a second axis forming an angle with the direction of flow of water through the cleaning head, the cleaning disc being provided with at least one perforation spaced from the center thereof;

a first steering arm projecting from the cleaning head in a direction transverse to the direction of movement, a proximal end of the arm being pivotally connectable to the cleaning head about a third axis substantially parallel to the direction of movement;

a suction device communicating with a low pressure region in the cleaning head, for intermittently applying suction to the surface of the swimming pool through the perforation in the cleaning disc; and a mechanism for intermittently causing the suction device to apply suction to the surface of the swimming pool, such that, each time the suction device applies suction to the surface of the swimming pool, the steering arm exercises a steering moment on the cleaning apparatus, causing the cleaning apparatus to change the direction of movement thereof.

8. A steering device as claimed in claim 7, wherein the suction device is adapted to engage with the surface of the swimming pool through the perforation in the cleaning disc each time the cleaning disc is rotated to a position in which the perforation is in register with the suction device.

9. A steering device as claimed in claim 7, comprising a second steering arm projecting from the cleaning head on the opposite side thereof in a direction substantially transverse to the direction of movement, a proximal end of the second steering arm being pivotally connectable to the cleaning head about a fourth axis which is also substantially parallel to the direction of movement, the second steering arm further comprising a second suction device communicating with a low pressure region in the cleaning head, for intermittently applying suction to the surface of the swimming pool, said second suction device being communicated to the second steering arm at a position spaced from a proximal end thereof; and a second mechanism for intermittently causing the second suction device to apply suction to the surface of the swimming pool, such that each time the second suction device applies suction to the surface of the swimming pool, the second steering arm exercises a steering moment on the cleaning apparatus, causing the cleaning apparatus to change the direction of movement thereof.

10. A steering device as claimed in claim 9, wherein the cleaning disc of the steering device is provided with a plurality of angularly spaced perforations, each perforation being provided at the same distance from the center of the disc as the suction device, the arrangement being such that, irrespective of the rotational position of the disc about the cleaning head, no two perforations will be located such as to simultaneously be in register with the suction device of the first and second steering arms.

11. A cleaning device as claimed in claim 7, wherein the suction device comprises a suction cup adapted, upon water being sucked therefrom by the low pressure region, to be pushed towards the surface of the swimming pool by the pressure of the water in the pool.

12. A cleaning disc for use with the steering device of claim 7, made of a suitable flexible material and having a centrally located hole for fitting rotatably into a groove provided around the head of a swimming pool cleaning apparatus, the disc having a perforation spaced from the center thereof at the same distance as the distance from the center to the suction device.

13. A swimming pool cleaning apparatus comprising:

a cleaning head;

a device for rotatably connecting a first end of the cleaning head about a first axis in line with the direction of flow through the cleaning head, to a flexible suction pipe of a circulating system for circulating water through the cleaning head, the suction pipe and back to the swimming pool;

a device for pulsating the flow through the cleaning head so as to cause the cleaning apparatus to be propelled along a surface of the swimming pool in a direction of movement;

a flexible, surface engaging cleaning disc rotatably mountable adjacent a second end of the cleaning head about a second axis forming an angle with the direction of flow of water through the cleaning head;

a first steering arm projecting from the cleaning head in a direction transverse to the direction of movement, a proximal end of the arm being pivotally connectable to the cleaning head about a third axis;

a suction device communicating with a low pressure region and a cleaning head, for intermittently applying suction to the surface of the swimming pool, connected to the first steering arm at a position remote from its proximal end; and a mechanism for intermittently causing the suction device to apply suction to the surface of the swimming pool, such that each time the suction device applies suction to the surface of the swimming pool, the first steering arm exercises a steering moment on the cleaning apparatus, causing the cleaning apparatus to change the direction of movement thereof.

14. A swimming pool cleaning apparatus as claimed in claim 13, wherein the cleaning disc is provided with at least one perforation spaced from its center, and wherein the suction device engages with the surface of the swimming pool through the perforation in the cleaning disc each time the cleaning disc is rotated to a position in which the perforation is in register with the suction device.

15. A swimming pool cleaning apparatus as claimed in claim 13, comprising a second steering arm projecting from the cleaning head on the opposite side thereof in a direction substantially transverse to the direction of movement, a proximal end of the second steering arm being pivotally connectable to the cleaning head about a fourth axis which is also substantially parallel to the direction of movement, the second steering arm further comprising a second suction device communicating with a low pressure region in the cleaning head, for intermittently applying suction to the surface of the swimming pool, said second suction device being connected to the second steering arm at a position spaced from a proximal end thereof; and a second mechanism for intermittently causing the second suction device to apply suction to the surface of the swimming pool, such that each time the second suction device applies suction to the surface of the swimming pool, the second steering arm exercises a steering moment on the cleaning apparatus, causing the cleaning apparatus to change the direction of movement thereof.

16. A swimming pool cleaning apparatus as claimed in claim 13, wherein the cleaning disc of the cleaning apparatus is provided with a plurality of angularly spaced perforations, each perforation being provided at the same distance from the center of the disc as the suction device, the arrangement being such that, irrespective of the rotational position of the disc about the cleaning head, no two perforations will be located such as to simultaneously be in register with the suction device of the first and second arms.

17. A swimming pool cleaning apparatus as claimed in claim 13, wherein the suction device comprises a suction cup adapted, upon water being sucked therefrom, to be pushed towards the surface of the swimming pool by the pressure of the water in the pool.

18. A swimming pool cleaning apparatus as claimed in claim 13, wherein said mechanism comprises a tube interconnecting the suction device with said low pressure region of the cleaning head.

* * * * *

UNITED STATES PATENT AND TRADEMARK OFFICE

CERTIFICATE OF CORRECTION

PATENT NO. : 5,317,777

DATED : June 7, 1994

INVENTOR(S) : Gerhardus J. STOLTZ

It is certified that error appears in the above-indentified patent and that said Letters Patent is hereby corrected as shown below:

On the title page, Item [30], the Foreign Application Priority Date should read as follows:

--Feb. 14, 1992--

Signed and Sealed this

Sixth Day of September, 1994

*Attest:*

Bruce Lehman

BRUCE LEHMAN

*Attesting Officer*

*Commissioner of Patents and Trademarks*